United States Patent [19]

Seifers et al.

[11] Patent Number: 5,016,230

[45] Date of Patent: May 14, 1991

[54] TIMING

[76] Inventors: Monte G. Seifers; Gary K. Gillum, Sr., both of 5163 Ashley Dr., Nashville, Tenn. 37211

[21] Appl. No.: 376,835

[22] Filed: Jul. 6, 1989

[51] Int. Cl.[5] ..... G04B 47/00; G04C 57/00

[52] U.S. Cl. ..... 368/10; 368/204; 368/155

[58] Field of Search ..... 368/155, 156, 200–204, 368/10

[56] References Cited

U.S. PATENT DOCUMENTS

| | | | |
|---|---|---|---|
| 4,367,955 | 11/1983 | Ballew | 368/10 |
| 4,419,016 | 12/1983 | Zoltan | 368/10 |
| 4,483,626 | 11/1984 | Noble | 368/89 |
| 4,589,780 | 5/1986 | Takebe | 368/250 |
| 4,768,176 | 8/1988 | Kehr et al. | 368/10 |
| 4,768,177 | 8/1988 | Kehr et al. | 368/10 |
| 4,837,719 | 6/1989 | McIntosh et al. . | |

*Primary Examiner*—Bernard Roskoski

*Attorney, Agent, or Firm*—Fish & Richardson

[57] ABSTRACT

A low power consumption timing device using an oscillator and chained CMOS flip-flop devices providing all time-dependent functions, with an audible and/or visual alarm which signals after a predetermined elapsed time and continues until deliberately reset especially useful for repetitively timed events such as reminders for taking medication at fixed intervals. When reset the elapsed timer begins the next timed interval. A minor circuit revision, makes possible an automatic reset of the timer mechanism after each elapsed interval without disturbing the signal latch. This alternate method can produce constant period cycles without regard to other signal reset mechanisms.

14 Claims, 3 Drawing Sheets

TIMING

BACKGROUND OF THE INVENTION

The present invention relates in general to timing and in particular to improved apparatus for providing repetitive timed events of predetermined duration that create a signal for indication of elapsed time, preferably within a mechanism attachable to a cap, such as for a medication container, for signaling the time for taking a medication therein.

The present invention has as an important object the provision of timing periods and signalling frequencies using a minimum of component size and complexity with minimal operating current and without the use of multiple oscillators or independent time-bases. This is accomplished by using a master CMOS Schmitt-trigger oscillator connected to chained CMOS logical flip-flops providing binary divided frequency/time-bases which are then connected to other CMOS logic to yield the final desired signal through a piezo effect audible transducer and/or a liquid crystal visual indicator.

Another important object of the invention is to latch the signalling device until deliberately reset by the operator. This is accomplished by connecting the final duration time base output to an R-S flip flop (latch) comprised of two dual input CMOS logical NOR gates.

Another important object of the invention is to provide an indication of battery readiness at the time of deliberate operator reset. This is accomplished by connecting an intermediate time base output to an R-S flip flop comprised of a pair of dual input CMOS logical NOR gates. The output of the signal latch flip flop and the battery readiness indicator flip flop are connected through diodes before coupling to prevent interaction.

It is a further object of the invention to achieve the foregoing object with reliably operating apparatus yielding repeatable output indications and virtually insensitive to all but the most severe variations in the battery supply.

SUMMARY OF THE INVENTION

According to the invention, means are provided to accept a reset signal which stops the signalling mechanism, triggers a two pulse battery readiness indication and, in one embodiment, resets the master time base. In another embodiment of the invention, the time base is reset automatically by the output of the final duration flip flop without interrupting the signal latch or battery readiness latch.

Preferably there is a mechanical reset device having three rotational detent positions. In a first extreme position which is typically most counterclockwise and is locked out of the rotation after a first typically clockwise rotation, the device removes positive supply power from the circuits and is in the idle, stocking or shipping position. In the middle position the device provides power to the circuit and connects positive potential (logical high or one) to the reset input. This middle position becomes the extreme typically most counterclockwise position after the initial typically clockwise twist of the mechanism. In all angular positions between and including the reset input position and the most second extreme typically clockwise position the device provides constant input of power to the circuit. In the second extreme typically clockwise preferably detent position the device provides mechanical stability for continuous power on.

Other features, objects and advantages of the invention will become apparent from the following specification when read in connection with the accompanying drawing in which:

DETAILED DESCRIPTION

Figure 1:
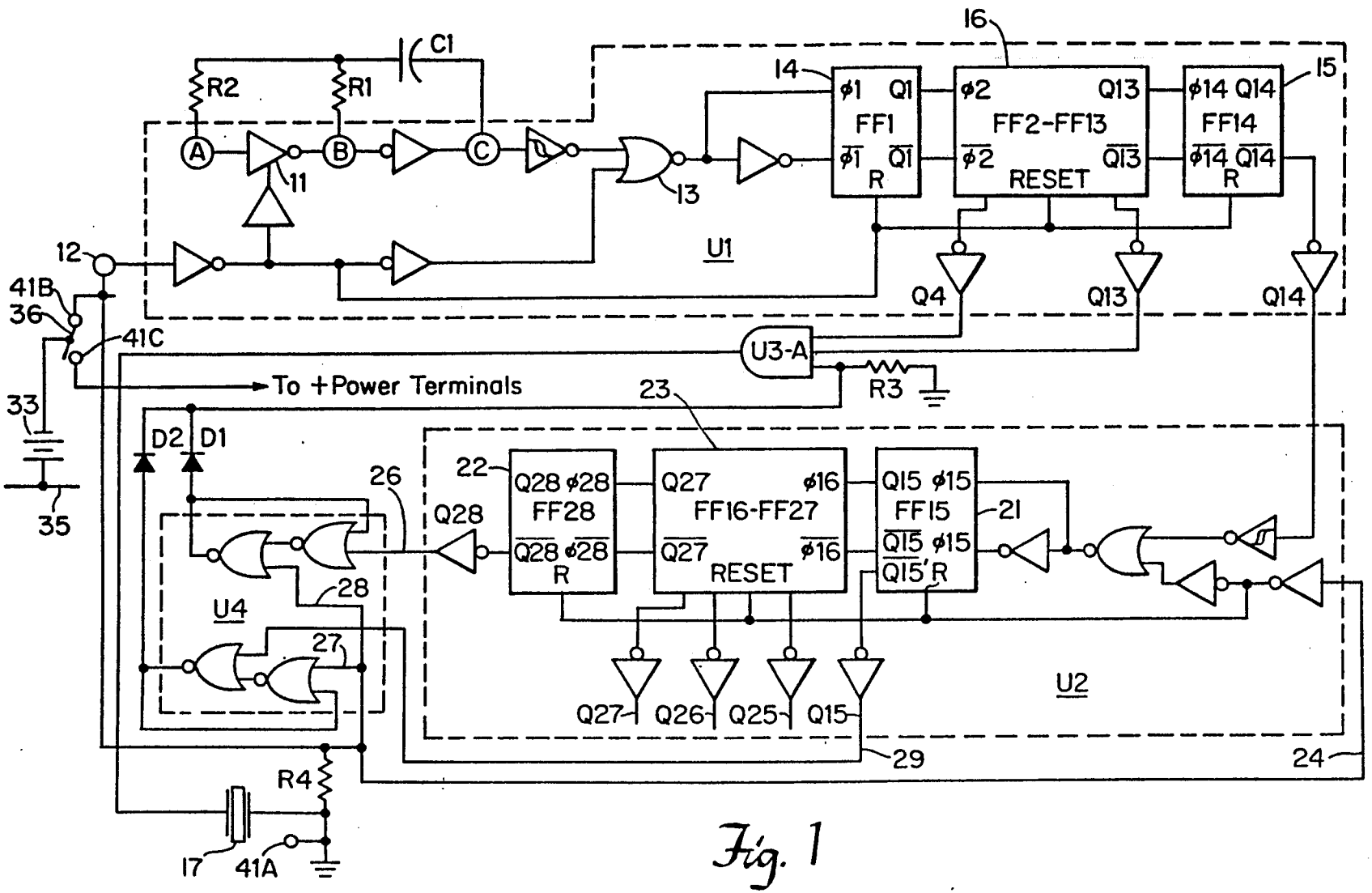
FIG. 1 is a combined block-schematic diagram illustrating the logical arrangement of an embodiment of the invention.

With reference now to the drawing and more particularly FIG. 1 thereof, there is shown a combined block-schematic circuit diagram of an exemplary embodiment of the invention. Capacitor C1 and resistor R1 provide a master oscillator time base of $t=2.2\times R1\times C1$ into a Schmitt-trigger inverter. Resistor R2 provides a stable feedback to the first chained oscillator inverter 11 which is gated by the absence of a reset signal on terminal 12. The output of the oscillator is NOR-®d by NOR gate 13 with the reset signal and inputted to the flip-flop chain comprising twenty-eight flip-flops FF1–FF28 shown as input flip-flop 14, output flip-flop 15 and intermediate flip-flops 16 of integrated circuit U1 an input flip-flop 21, output flip-flop 22 and intermediate flip-flops 23 of integrated circuit U2. Application of a high reset signal potential to terminal twelve disables the oscillator and sets all flip-flop outputs to substantially zero (low). Resistor R4 pulls down the reset input to prevent false signalling.

Figure 2:
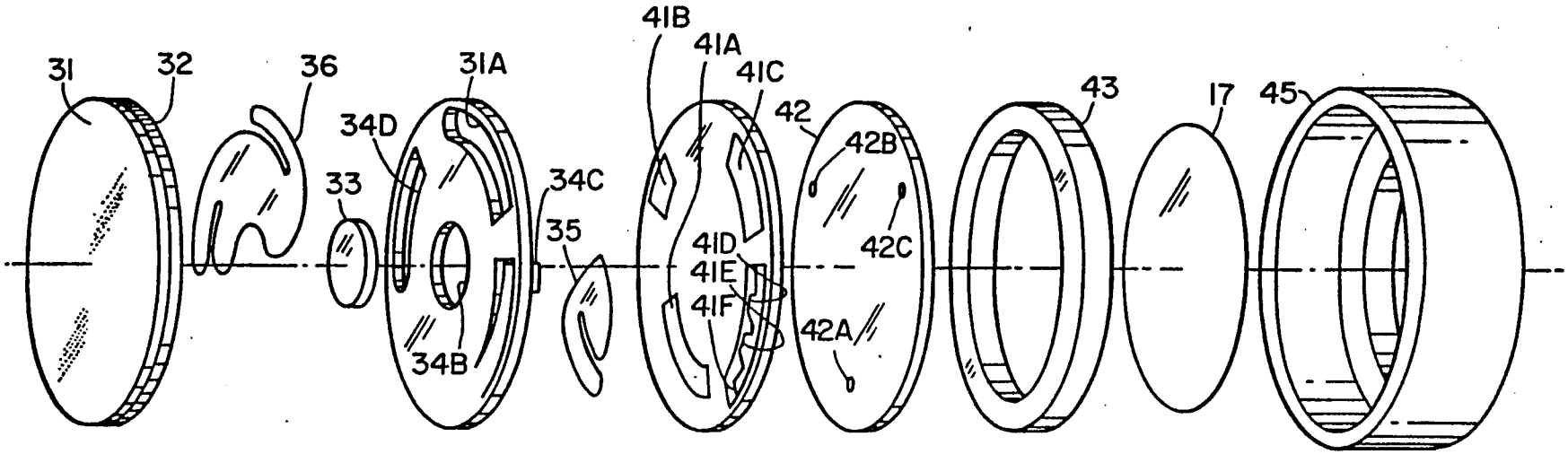
FIG. 2 is an exploded view of the mechanical assembly of an embodiment of the invention especially suitable for attachment to a medication container cap.

At the left of FIG. 1 there is shown a schematic representation of battery 33, negative (ground) sweeper 35, positive sweeper 36, reset track 41B and power track 41C shown as mechanical elements in FIG. 2.

The output Q4 from flip-flop FF4 provides the base freguency for the audible tone which is pulsed by the output Q13 of flip-flop FF13 through triple-input AND gate U3-A and gated through triple-input AND gate U3-A either by the high output from the battery readiness latch, comprising the lower two NOR gates of integrated circuit U4; namely, U4-C and U4-D, (set by the reset signal on terminal 12 and reset on line 29 by the output Q15 of flip-flop FF15) or by the high condition of the final output latch, comprising the upper two NOR gates of integrated circuit U4; namely, U4-A and U4-B, flops FF28-25, respectively, and reset by the reset signal on terminal 12. The output of trip)e-input AND gate U3-A provides the signal to the piezo audible transducer 17.

Diodes D1 and D2 couple the battery readiness latch with the final duration output latch to prevent interaction and allow independent signalling through the triple-input AND gate U3-A. Resistor R3 pulls down the coupled input to U3-A during a no-latch condition. Diodes D1 and D2 with resistor R3 constitute a logical OR gate.

The Schmitt-trigger inverter and associated logic between flip-flops FF14 and FF15 are not required for proper operation of the circuit but are advantageously used in this embodiment because integrated circuit U1 then may be a standard CMOS logic circuit and integrated circuit U2 may be a slightly simpler standard CMOS logic circuit.

The output Qn at each chained flip-flop provides a time delay of $1.1 \times R1 \times C1 \times 2^n$. If the oscillator frequency is chosen to yield an output at Q28 of 8 hours, then Q27 would provide a 4-hour timer, Q26 a 2-hour timer, and Q25 a 1-hour timer. Thus for the common medication intervals of 12-, 8-, 6-, 4-, 3-, 2- and 1-hours, only two master oscillator frequencies are sufficient.

To provide a repetitive fixed interval timer described as an alternate embodiment, the final duration timer output (from the selected one of buffer outputs Q28, Q27, Q26, or Q25) is connected to the reset terminal 12 of integrated circuit U1 and reset line 24 of integrated circuit U2 and the final output latch SET-input 26. The mechanical reset switch is only connected to the battery readiness latch SET-input 27 and the final output latch RESET-input 28 as shown and not to the reset inputs of the integrated circuits U1 and U2.

The term reset signal is used in the description to denote a potential at or near the supply potential which is recognized as a logical one. The terms high and low are used in the description to denote the potential relative to ground ($V_{SS}$) with low being at or near ground potential and high being of sufficient potential to cause an inverter to be held in a high input condition.

Referring to FIG. 2, there is shown an exploded view of an exemplary embodiment of a mechanical assembly according to the invention especially suitable for attachment to the cap of a medication container so that unscrewing (or screwing on the medication container cap resets the timing circuit to begin counting pulses during the next interval between recommended contiguous times for taking the medication in the container.

The assembly includes a stationary assembly to the left and a rotating assembly to the right.

The stationary assembly includes an adhesive pad 31 for attachment to a medication container cap, an insulating disk 32, a positive sweeper 36, a coin cell battery 33, a bottom ratchet and insulator 34 and a negative (ground) sweeper 36. The rotating assembly comprises a top ratchet and power plane 41, a circuit card 42 with power via openings 42A, 42B and 42C, an insulating spacer 43, a piezo electric element 44 and a cap and piezo electric chamber 45 in which the elements to the left nest when assembled. Positive sweeper 36 contacts the positive terminal of coin cell batter 33 at the left and passes through circumferential grooves 34A and 34D in bottom ratchet and insulator 34. Negative (ground) sweeper 35 contacts the negative terminal of coin cell battery 33 seated in opening 34B of bottom ratchet and insulator 34 for contacting ground track 41A of top ratchet and power plane 41. Reset track 41B, power track 42C and ground track 41A contact via openings 42B, 42C and 42A respectively, to terminal 12, positive supply ($V_{DD}$) and ground ($V_{SS}$), respectively, of FIG. 1. Piezo electric element 44 (17) is connected to the output of gate U3-A and to ground ($V_{SS}$) of FIG. 1.

Figure 3:
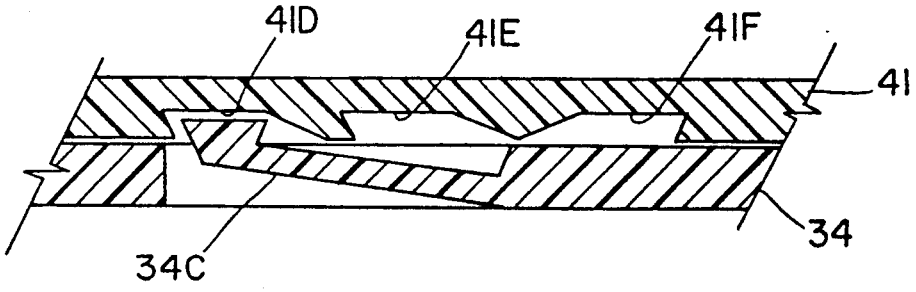
FIG. 3 is an edge sectional view of components of the mechanical assembly.

Referring to FIG. 3, there is shown an edge sectional view of bottom ratchet and insulator 34 and top ratchet and power plane 41 helpful in understanding the mode of operation. Ratchet arm 34C rides up in one of ship channel 41D, reset channel 41E or run channel 41F. Ratchet arm 34C initially resides in the ship (or stocking) extreme counterclockwise channel as shown when the assembly is initially shipped before using so that the battery remains disconnected from the circuitry with the battery current zero. A pharmacist or patient may then attach adhesive pad 31 to the top of a medication cap. When the cap assembly is first replaced onto a container by twisting the rotating assembly cap and piezo electric chamber 45 clockwise, then ratchet arm 34C moves first into reset channel 41E causing positive sweeper 36 to engage both power track 41C energizing the circuitry and reset track 41B which supplies reset potential to terminal 12 of FIG. 1. Further clockwise rotation moves ratchet arm 34C into run channel 41F, disconnecting positive sweeper 36 from reset track 41B but not removing supply current from power track 41C allowing counting to occur in the electronic circuit which ultimately provides an output signal that energizes piezo electric element 44 (17 in FIG. 1) at the end of that counting interval, providing an audible signal to the patient that it is time to take the next dose in the medication container. After the initial clockwise rotation of the rotating assembly, the engaging angles of ratchet arm 34C and reset channel 41E, prevent return of the assembly to the ship position thereby preventing the inadvertent deactivation of the circuit.

TABLE I

| | (FOR 8 HOUR MAXIMUM TIMER) |
|---|---|
| C1 | 0.01 MFD 25 VOLT CERAMIC CAPACITOR |
| D1-D2 | 1N914 SMALL SIGNAL DIODE |
| R1 | 10 K-OHM METAL FILM RESISTOR TRIMMED TO 9.753 K-OHM |
| R2-R4 | 47 K-OHM METAL FILM RESISTOR |
| U1 | CD4060 CMOS INTEGRATED CIRCUIT |
| U2 | CD4020 CMOS INTEGRATED CIRCUIT |
| U3 | CD4073 TRIPLE THREE-INPUT CMOS AND GATE IC |
| U4 | CD4001 QUAD DUAL-INPUT CMOS NOR GATE IC |
| PIEZO | PIEZO EFFECT AUDIBLE TRANSDUCER |

There has been described a novel apparatus and techniques for economically and reliably providing a repetitive fixed duration timer with audible and/or visual indication of a predetermined elapsed time transpired with reliable economical compact circuitry that dissipates negligible power. Table I sets forth specific parameter values in a preferred embodiment. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims:

What is claimed is:

1. A medication timer assembly for attachment to a medication container comprising, an electronic timing circuit having a reset input and output, an end-of-time interval indicator connector to the output of said electronic timing circuit, attaching means for attaching the medication timer assembly to a medication container, a battery, and a powering mechanism for selectively connecting the battery to the electronic timing circuit characterized by a reset position in which the battery delivers electric power to the electronic timing circuit and is coupled to the reset input to provide a reset signal that resets the electronic timing circuit to an initial condition, and a run position in which the battery delivers electric power to the electronic timing circuit so that said electronic timing circuit provides an output signal to the end-of-time interval indicator signifying the end of a predetermined timed interval and wherein said powering mechanism comprises relatively movable elements defining at least two rotational detent positions corresponding to said reset and run positions.

2. An assembly in accordance with claim 1 and further comprising, a medication container attached to said medication timer assembly by said attaching means.

3. A medication timer assembly in accordance with claim 1 wherein said electronic timing circuit comprises, an oscillator, a source of a common reset signal, cascaded flip-flops coupled to said oscillator for providing output pulses on a plurality of outputs including at least first and second intermediate outputs in response to a predetermined number of input pulses from said oscillator and arranged to be reset by said common reset signal, a timing duration latch having a latched output and arranged to be set by any one of said output pulses following a reset signal and reset by said common reset signal, a battery readiness latch having a latched output arranged to be set by said common reset signal and reset after an intermediate output pulse from said first intermediate output, diodes coupled to said latched outputs preventing interaction therebetween, a triple input AND gate having a first input for receiving an audible tone signal from one of said intermediate outputs, a second input for receiving output pulses from said second intermediate output and a third input coupled to said latched outputs by said diodes, and an end-of-time-interval indicator coupled to the output of said AND gate.

4. A medication timer assembly in accordance with claim 3 and further comprising a mechanical reset mechanism comprising, relatively movable elements defining at least two detent positions a first of which is arranged to provide continuous supply power and said common reset signal, and a second of which is arranged to provide continuous supply power without said common reset signal to said circuitry.

5. A medication timer assembly in accordance with claim 3 wherein said electronic timing circuit consists of not more than standard CMOS integrated circuits, 2 diodes, 4 resistors, a capacitor, an indicator and a reset mechanism.

6. A medication timer assembly in accordance with claim 3 wherein said electronic timing circuit includes means for indicating a supply battery readiness upon each reset cycle.

7. A medication timer assembly in accordance with claim 4 wherein said electronic timing circuit includes means for maintaining continuous output until said reset mechanism is intentionally reset.

8. A medication timer assembly in accordance with claim 1 wherein said powering mechanism is further characterized by a stocking position in which the battery is disconnected from the electronic timing circuit and the battery current is zero.

9. An assembly in accordance with claim 8 wherein said powering mechanism comprises relatively movable elements defining three rotational detent positions corresponding to said stocking, reset, and run positions respectively.

10. A medication timer assembly in accordance with claim 4 wherein said mechanical reset mechanism relatively movable elements further define a third detent position which is arranged for removing power for shipping and storage in a third extreme position.

11. Timer circuitry comprising, an oscillator, a source of a common reset signal, cascaded flip-flops coupled to said oscillator for providing output pulses on a plurality of outputs including at least first and second intermediate outputs in response to a predetermined number of input pulses from said oscillator and arranged to be reset by said common reset signal, a timing duration latch having a latched output and arranged to be set by any one of said output pulses following a reset signal and reset by said common reset signal, a battery readiness latch having a latched output arranged to be set by said common reset signal and reset after an intermediate output pulse from said first intermediate output, diodes coupled to said latched outputs preventing interaction therebetween, a triple input AND gate having a first input for receiving an audible tone signal from one of said intermediate outputs, a second input for receiving output pulses from said second intermediate output and a third input coupled to said latched outputs by said diodes, and an end-of-time-interval indicator coupled to the output of said AND gate and further comprising a mechanical reset mechanism comprising relatively movable elements defining at least two detent positions a first of which is arranged to provide continuous supply power and said common reset signal, and a second of which is arranged to provide continuous supply power without said common reset signal to said circuitry.

12. Timer circuitry in accordance with claim 11 wherein said circuitry consists of not more than four standard CMOS integrated circuits, two diodes, four resistors, a capacitor, an indicator, and a reset mechanism.

13. Latching circuitry in accordance with claim 11 wherein said circuitry includes means for indicating a supply battery readiness upon each reset cycle.

14. Latching circuitry in accordance with claim 11 wherein said circuitry includes means for maintaining continuous output until said reset mechanism is intentionally reset.

* * * * *